US010202821B2

(12) United States Patent
Hemmingsen et al.

(10) Patent No.: US 10,202,821 B2
(45) Date of Patent: Feb. 12, 2019

(54) METHOD OF PLUGGING A WELL

(71) Applicant: STATOIL PETROLEUM AS, Stavanger (NO)

(72) Inventors: Pål Viggo Hemmingsen, Trondheim (NO); Gjermund Grimsbo, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 230 days.

(21) Appl. No.: 14/915,044

(22) PCT Filed: Aug. 30, 2013

(86) PCT No.: PCT/EP2013/068035

§ 371 (c)(1),
(2) Date: Feb. 26, 2016

(87) PCT Pub. No.: WO2015/028093

PCT Pub. Date: Mar. 5, 2015

(65) Prior Publication Data

US 2016/0215586 A1 Jul. 28, 2016

(51) Int. Cl.

| | |
|---|---|
| ***E21B 33/13*** | (2006.01) |
| ***E21B 33/134*** | (2006.01) |
| ***E21B 17/10*** | (2006.01) |
| ***E21B 17/00*** | (2006.01) |

(52) U.S. Cl.

CPC ..... *E21B 33/13* (2013.01); *E21B 17/00* (2013.01); *E21B 17/1035* (2013.01); *E21B 33/134* (2013.01)

(58) Field of Classification Search

CPC ..... E21B 33/13

See application file for complete search history.

(56) References Cited

U.S. PATENT DOCUMENTS

| | | | | |
|---|---|---|---|---|
| 2,855,685 A | | 10/1958 | Barreteau | |
| 4,501,330 A | * | 2/1985 | Garcia | E21B 17/06 166/285 |
| 5,524,709 A | * | 6/1996 | Withers | B09B 1/006 166/250.1 |
| 5,892,733 A | * | 4/1999 | Havig | E21B 47/00 367/188 |
| 5,925,879 A | * | 7/1999 | Hay | E21B 33/1243 250/227.14 |
| 6,125,935 A | * | 10/2000 | Shahin, Jr. | E21B 33/14 166/250.14 |
| 6,230,800 B1 | * | 5/2001 | Bryant | E21B 33/13 166/250.01 |

(Continued)

FOREIGN PATENT DOCUMENTS

WO WO 2010/088542 A1 8/2010

*Primary Examiner* — Kenneth L Thompson

(74) *Attorney, Agent, or Firm* — Birch, Stewart, Kolasch & Birch, LLP

(57) ABSTRACT

A method of plugging a well includes providing a tubing in a wellbore, wherein in a location for a well plug, the tubing is provided with an internal cable section placed inside of the tubing and/or an external cable section placed outside of the tubing, the external cable section including a fluid-tight cable suitable for forming a sealing part of the well plug, and forming a plug in the well in the location for the well plug without pulling the tubing from the wellbore.

21 Claims, 2 Drawing Sheets

(56) References Cited

U.S. PATENT DOCUMENTS

| | | | | |
|---|---|---|---|---|
| 6,478,086 | B1 | 11/2002 | Hansen | |
| 6,840,114 | B2 * | 1/2005 | Niezgorski | G01L 1/246 73/800 |
| 6,847,034 | B2 * | 1/2005 | Shah | E21B 23/08 166/250.01 |
| 6,957,574 | B2 * | 10/2005 | Ogle | E21B 47/0006 73/152.48 |
| 9,488,034 | B2 * | 11/2016 | Shaw | E21B 17/023 |
| 2004/0007829 | A1 * | 1/2004 | Ross | E21B 33/1208 277/626 |
| 2011/0127035 | A1 * | 6/2011 | Hansen | E21B 33/13 166/297 |
| 2015/0068738 | A1 * | 3/2015 | Wayne | E21B 47/06 166/250.11 |

* cited by examiner

Standard control cables
Barrier approved control cables
Hollow lines
Production packer
Gas tight enter/exit hydraulic line seal
Well plug

METHOD OF PLUGGING A WELL

FIELD OF THE INVENTION

The present invention relates to a method of plugging a well. In particular embodiments, the method comprises installing a permanent fluid-tight barrier for well abandonment.

BACKGROUND TO THE INVENTION

The NORSOK standard D-10 rev.3 which is the basis for well integrity in drilling and well operations on the Norwegian Continental Shelf, including plug and abandonment procedures, states that "Control cables and lines shall be removed from areas where permanent well barriers are installed, since they may create vertical leak paths through the well barrier." The main problem relates specifically to the insulation material of the control cables, which may degrade, creating void space between the plug material and the cable. Another problem is hydraulic lines, which are hollow and therefore cannot be a part of a permanent barrier. If the location for a permanent barrier contains control cables and lines, the practice today is to remove these by pulling out the whole production tubing which the cables and lines are attached to. This requires a drill rig onsite. Problems associated with this procedure are high time demands and cost, and potential safety issues.

WO10088542 aims to address these problems by forming a well barrier with a cable passing through the barrier and though fluid-tight pressure tested connectors. Cementation is performed around the connector and the cable is run on the outside of the tubing into a passageway through the connector. Thus, although the cable passes through the barrier, it is sealingly located in a passageway with pressure rated connectors provided at either end of the passageway. Of course, failure of the connectors could result in a fluid flow path through the barrier so the integrity of this system relies on the integrity of the connectors.

It is an aim of the present invention to provide an alternative method of plugging a well which helps to address the afore-mentioned problems.

SUMMARY OF THE INVENTION

In accordance with a first aspect of the present invention there is provided a method of plugging a well comprising:

- providing a tubing in a wellbore, wherein in a location for a well plug, the tubing is provided with an internal cable section placed inside of the tubing and/or an external cable section placed outside of the tubing, the external cable section comprising a fluid-tight cable suitable for forming a sealing part of the well plug; and
- forming a plug in the well in said location for the well plug without pulling the tubing from the wellbore.

Embodiments of the invention therefore effectively employ barrier-approved external cables in pre-set locations so that the well can be abandoned without requiring the tubing (and associated cables) to be pulled out of the wellbore prior to formation of a plug. Consequently, the plugging of the well can be performed using lighter equipment such as coil tubing or wireline. Accordingly, the invention can be implemented to save time and cost associated with plug and abandonment procedures whilst also reducing safety risks related to the traditional step of pulling the tubing from the wellbore using a drill rig.

As the external cable itself is fluid-tight there is no need for additional connectors or a specially designed tubing section, thus reducing complexity and minimising the risk of fluid leak due to failure of a single critical component. In fact, due to the elongate nature of the external cable even a point failure along the length of the external cable would not be catastrophic as the remaining sections of fluid-tight external cabling would prevent a fluid flow path from being established through the well plug.

It will be understood that the fluid-tight external cable will be exposed to the annular space where the plug is to be provided and the plugging material (e.g. concrete) will be set within the annulus so as to encapsulate the external control cable section therein.

An advantage of placing the internal cable section inside the tubing is that it is readily accessible and can easily be removed during a plug or abandonment procedure.

The step of providing the tubing in the wellbore may be implemented during completion of a new well or during re-completion of an old well.

In embodiments where the tubing is provided with an external cable section placed outside of the tubing in said location for a well plug, the step of forming a plug in the well may comprise:

- forming a fluid-tight seal in a wellbore annulus surrounding the tubing, with the external cable section forming a part of the seal, for separating, either side of the seal, first and second fluid volumes of the wellbore annulus.

The fluid-tight external cable is ideally designed and manufactured in such a way that no internal voids exist in the cable. Additionally or alternatively, the step of forming a plug in the well may comprise sealing any interior cavities in the external cable. Furthermore, the fluid-tight external cable may have an external surface which will not degrade under wellbore conditions to cause a leak path through the well plug and that will readily seal with the material forming the plug. The external surface may be provided by a coating (e.g. insulating) layer. This may also be advantageous in reducing the risk of possible leakage paths developing during production, transportation or installation of the tubing.

The (or each) external cable may, for example, be configured as an electrical control cable, a hydraulic line, a fiber optic cable or a support cable (also known as a bumper cable). As is common in the field, the support cable may be configured to withstand loads that may otherwise damage or tear apart the other cables. The support cable may be made of braided wire and may, in particular, be used during the winter season when floating rigs tend to experience maximum movement due to high wind and/or waves.

In some embodiments, a plurality of external cables may be provided outside of the tubing, in the location for the well plug. In particular embodiments, all cables may be provided as external cables outside of the tubing, in the location for the well plug.

The method may comprise sealing all of the external cables provided outside of the tubing. This may be achieved by providing a fluid-tight exterior to each external cable and by filling any interior cavities with a sealing material. For example, a sealant may be pumped into a hydraulic line to fill the cavity therein.

In embodiments where the tubing is provided with a section of internal cable placed inside the tubing in said location for the well plug, the step of forming a plug in the well may comprise:

- substantially removing the internal cable section inside the tubing; and forming a fluid-tight seal in the tubing where the internal cable section has been removed, for separating, either side of the seal, first and second fluid volumes of the tubing.

In some embodiments, a plurality of internal cables may be provided inside of the tubing, in the location for the well plug. In particular embodiments, all cables may be provided as internal cables inside of the tubing, in the location for the well plug.

The (or each) internal cable may, for example, be configured as an electrical control cable, a hydraulic line, a fiber optic cable or a support cable (also known as a bumper cable).

The step of removing the internal cable section inside the tubing may comprise cutting, milling, dissolving or otherwise destroying the internal cable section to ensure that there is no fluid flow path through the internal cable in the location for the well plug.

The step of providing a tubing in a wellbore with a section of internal cable placed inside the tubing in said location for the well plug may comprise providing a tubing having a further section of cable placed outside the tubing and a port through which the further section of cable transitions from the outside of the tubing to the inside of the tubing to connect with said section of cable placed inside the tubing. The port will be configured to form a fluid-tight seal with the tubing.

The step of forming the plug in the well may comprise creating a hole in the tubing in the location for the well plug and introducing plugging material into the wellbore and through the hole. Multiple holes (i.e. perforations) may be created in the tubing in the location for the well plug. The hole or holes may be conveniently located above a production packer. A temporary plug may be provided in the tubing below the location of the hole or holes so as to form a shelf or ledge on which the plugging material within the tubing may set.

The step of forming a fluid-tight seal may be performed by introducing cement (which will set as concrete plugging material) into the wellbore, which seals against the tubing and the external cable section.

The fluid-tight seal may be formed to meet the requirements of a permanent well barrier.

The method may comprise forming multiple plugs in the wellbore at a number of locations configured for such well plugs.

The tubing may be constituted by production tubing.

The fluid-tight external cable may comprise one or more of the following:

non-braided wire;

gas-tight construction;

continuous conductive screen;

ceramic, porcelain, glass, mineral or composite type coating; and electric wire.

According to a second aspect of the invention, there is provided a method of performing a wellbore operation, comprising:

providing a tubing in a wellbore, wherein in a location for a well plug, the tubing is provided with an internal cable section placed inside of the tubing and/or an external cable section placed outside of the tubing, the external cable section comprising a fluid-tight external cable suitable for forming a sealing part of the well plug; and using the tubing in a wellbore operation.

According to a third aspect of the invention, there is provided a wellbore apparatus comprising:

a tubing section configured to be located in a wellbore, in a location for a future well plug;

the tubing section provided with an internal cable section placed inside of the tubing section and/or an external cable section placed outside of the tubing section, the external cable section comprising a fluid-tight external cable suitable for forming a sealing part of the well plug upon plugging the wellbore.

According to a fourth aspect of the invention, there is provided a fluid-tight external cable (e.g. a fluid-tight electrical cable) for use in a wellbore.

BRIEF DESCRIPTION OF THE DRAWINGS

Specific embodiments of the present invention will now be described with reference to the accompanying drawings, in which.

DETAILED DESCRIPTION OF CERTAIN EMBODIMENTS

Figure 1:
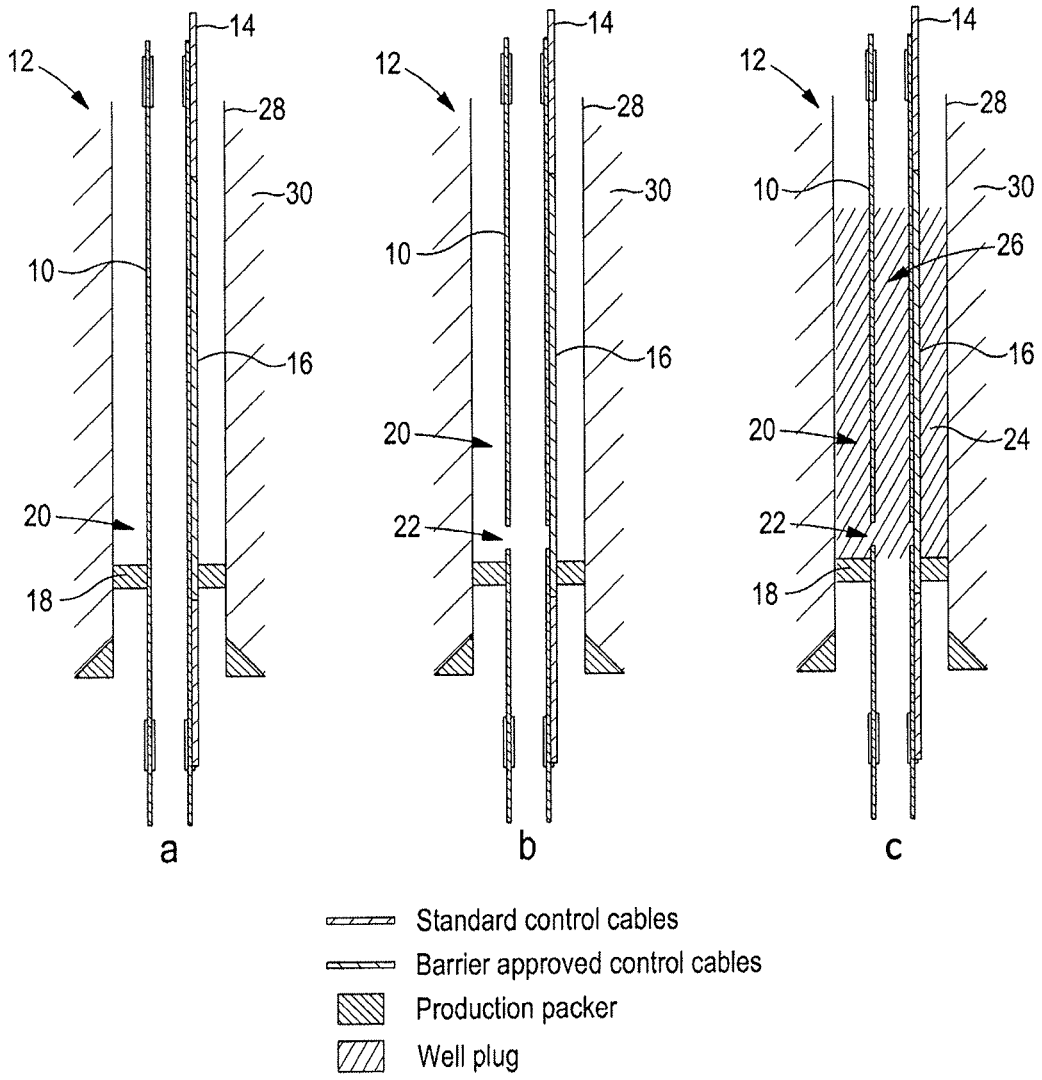
FIG. 1*a* shows a longitudinal cross-sectional view of a wellbore provided with tubing having an external electrical control cable section placed outside of the tubing in accordance with a first embodiment of the invention.
FIG. 1*b* shows the wellbore of FIG. 1*a* after a section of the tubing has been removed during a plugging procedure.
FIG. 1*c* shows the wellbore of FIG. 1*b* after cement has been injected through the tubing to form a plug across the width of the wellbore.

With reference to FIGS. 1*a, b* and *c*, there is illustrated a method for plugging a well in accordance with a first embodiment of the present invention. The method comprises providing a production tubing 10 in a wellbore 12, the tubing 10 being provided with a (standard) electrical control cable 14 along the outside of the tubing 10 but wherein, in a location for a well plug, the tubing 10 is provided with an external electrical control cable section 14 (also placed outside of the tubing 10), the electrical control cable section 14 comprising a fluid-tight electrical cable 16 suitable for forming a sealing part of a well plug. In this embodiment, the fluid-tight electrical cable 16 comprises a ceramic coating.

In particular embodiments, the fluid-tight electrical cable 16 may have a length of between 60 m and 200 m. However, it be understood that the required length will depend upon the desired length of the well plug to be formed around the fluid-tight electrical cable 16 and the accuracy of the procedures for providing the fluid-tight electrical cable 16 in the location for the well plug. In other embodiments, the (standard) electrical control cables 14 may be replaced with fluid-tight electrical cable 16 so that a well plug can be placed at any location along the length of the tubing.

As illustrated, a production packer 18 is provided in an annulus 20 surrounding the tubing 10, at or close to a lowermost region of the location for the well plug. A hole 22 is milled in the tubing 10, above the production packer 18, and a plugging material 24 (e.g. comprising cement) is introduced through the tubing 10 so as to form a well plug 26 in the tubing 10 and the annulus 20, in the location for the well plug. Accordingly, the plugging material 24 will encapsulate and seal against the tubing 10 and the fluid-tight electrical cable 16 in the location for the well plug 26.

Although not shown, a temporary plug may be provided in the tubing 10 below the location of the hole 22 so as to form a shelf or ledge on which the plugging material 24 within the tubing 10 may set.

It will be understood that, in practice, the tubing 10 will be provided within one or more outer casings 28 which are cemented in place. It may therefore be necessary to check that the outer casing cement 30 is properly placed and verified as a permanent barrier.

Figure 2:
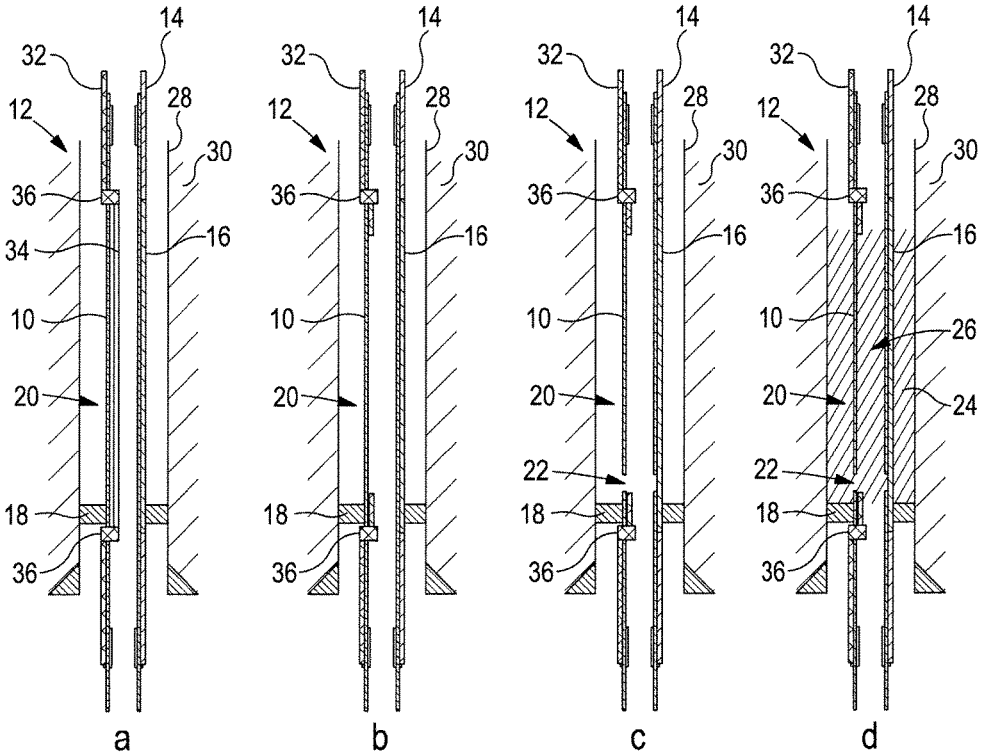
FIG. 2*a* shows a view similar to that of FIG. 1*a* but wherein the tubing further comprises an internal fluid cable section placed inside the tubing, in accordance with a second embodiment of the invention.
FIG. 2*b* shows the wellbore of FIG. 2*a* after the inner fluid cable section has been removed.
FIG. 2*c* shows the wellbore of FIG. 2*b* after the a hole has been created in the tubing in the location for the well plug.
FIG. 2*d* shows the wellbore of FIG. 2*c* after plugging material has been introduced into the wellbore, to form a plug across the width of the tubing and surrounding annulus.

FIGS. 2*a, b, c* and *d* illustrate a method for plugging a well in accordance with a second embodiment of the present invention. This method is similar to that described above in relation to FIGS. 1*a* through 1*c* and so like reference numerals will be employed. In this embodiment the tubing 10 is further provided with a (standard) fluid line 32 provided on the outside of the tubing 10 but wherein, in a location for a well plug, the tubing 10 is provided with a fluid cable section 34 placed inside of the tubing 10. For example, the fluid cable section 32 may be constituted by a hollow hydraulic line or a hollow injection line. The outer (standard) fluid line 32 is fluidly connected to the inner fluid cable section 34 through entry and exit transition ports 36, which are provided in the tubing 10. The transition ports 36 are configured to form a fluid-tight seal with the tubing 10.

As illustrated in FIG. 2*b*, the provision of the fluid cable section 34 inside the tubing 10 permits access to the hollow line so that it can be milled out in the location of the well plug thereby removing a potential fluid flow path through the plug.

Once the fluid cable section 34 has been removed, the method proceeds as described above. This, FIGS. 2*c* and 2*d* show the production packer 18 provided in the annulus 20 surrounding the tubing 10 and a hole 22 milled in the tubing 10, above the production packer 18, for introduction of the plugging material 24. As before, the plugging material 24 encapsulates and seal against the tubing 10 and the fluid-tight electrical cable 16 in the location for the well plug 26.

Aspects of the invention therefore relate to the installation of control cables and lines during completion of a new well or re-completion of an old well, which can form a part of a permanent barrier, thereby minimising the time, cost and safety concerns associated with traditional plug and abandonment techniques.

It will be appreciated by persons skilled in the art that various modifications may be made to the above-described embodiments without departing from the scope of the present invention, as defined by the claims.

The invention claimed is:

1. A method of plugging a well in a plug and abandonment procedure, comprising:

providing a tubing in a wellbore, wherein in a location for a well plug, the location for a well plug being spaced above a bottom of the well bore, the tubing is provided with an internal cable section placed inside of the tubing and a further section of cable placed outside the tubing and a port through which the further section of cable transitions from outside of the tubing to inside of the tubing to connect with the internal cable section placed inside the tubing; and forming a plug in the well in said location for the well plug, the plug extending across a width of the tubing and a surrounding wellbore annulus to create a permanent barrier without pulling the tubing from the wellbore.

2. The method according to claim 1, wherein the step of providing the tubing in the wellbore is implemented during completion of a new well or during re-completion of an old well.

3. The method according to claim 1, wherein the step of forming a plug in the well comprises:

substantially removing the internal cable section inside the tubing; and forming a fluid-tight seal in the tubing where the internal cable section has been removed, for separating, either side of the seal, first and second fluid volumes of the tubing.

4. The method according to claim 1, wherein the internal cable section is configured as an electrical control cable, a hydraulic line, a fiber optic cable or a support cable.

5. The method according to claim 1, wherein a plurality of internal cables are provided inside of the tubing, in the location for the well plug.

6. The method according to claim 3, where the step of removing the internal cable section inside the tubing comprises cutting, milling, dissolving or otherwise destroying the internal cable section to ensure that there is no fluid flow path through the internal cable section in the location for the well plug.

7. The method according to claim 1, wherein the step of forming the plug in the well comprises creating a hole in the tubing in the location for the well plug and introducing plugging material into the wellbore and through the hole.

8. The method according to claim 7, wherein a temporary plug is provided in the tubing below the location of the hole so as to form a shelf or ledge on which the plugging material within the tubing may set.

9. The method according to claim 1, comprising forming multiple plugs in the wellbore at a number of locations configured for such well plugs.

10. The method according to claim 1, further comprising providing an external cable section placed outside of the tubing in the location for the well plug, the external cable section comprising a fluid-tight cable suitable for forming a sealing part of the well plug.

11. The method according to claim 10, wherein the step of forming a plug in the well comprises:

forming a fluid-tight seal in a wellbore annulus surrounding the tubing, with the external cable forming a part of the seal, for separating, either side of the seal, first and second fluid volumes of the wellbore annulus.

12. The method according to claim 10, wherein the external cable section is designed and manufactured in such a way that no internal voids exist in the external cable section.

13. The method according to claim 10, wherein the step of forming a plug in the well comprises sealing any interior cavities in the external cable section.

14. The method according to claim 10, wherein the external cable section has an external surface which will not degrade under wellbore conditions to cause a leak path through the well plug and that will readily seal with the material forming the plug.

15. The method according to claim 14, wherein the external surface is provided by a coating layer.

16. The method according to claim 10, wherein the external cable section is configured as an electrical control cable, a hydraulic line, a fiber optic cable or a support cable.

17. The method according to claim 10, wherein a plurality of external cables are provided outside of the tubing, in the location for the well plug.

18. The method according to claim 17, comprising sealing all of the external cables provided outside of the tubing.

19. The method according to claim 10, wherein the external cable section comprises one or more of the following:

non-braided wire;

gas-tight construction;

continuous conductive screen;

ceramic, porcelain, glass, mineral or composite type coating; and electric wire.

20. A method of performing a wellbore operation, comprising:

providing a tubing in a wellbore, wherein in a location for forming a well plug, the well plug extends across a width of the tubing and a surrounding wellbore annulus to create a permanent barrier, the location for a well plug being spaced above a bottom of the well bore, the tubing is provided with an internal cable section placed inside of the tubing and a further section of cable placed outside the tubing and a port through which the further section of cable transitions from outside of the tubing to inside of the tubing to connect with the internal cable section placed inside the tubing; and using the tubing in a wellbore operation.

21. A wellbore apparatus, comprising:

a tubing section configured to be located in a wellbore, in a location for a future well plug extending across a width of the tubing and a surrounding wellbore annulus to create a permanent barrier, the location for the future well plug being spaced above a bottom of the well bore; and the tubing section provided with an internal cable section placed inside of the tubing section and a further section of cable placed outside the tubing and a port through which the further section of cable transitions from outside of the tubing to inside of the tubing to connect with the internal cable section placed inside the tubing.

* * * * *